US008177963B2

(12) United States Patent
Greaney et al.

(10) Patent No.: US 8,177,963 B2
(45) Date of Patent: May 15, 2012

(54) PARTIAL ELECTRO-HYDROGENATION OF SULFUR CONTAINING FEEDSTREAMS FOLLOWED BY SULFUR REMOVAL

(75) Inventors: Mark A. Greaney, Upper Black Eddy, PA (US); Kun Wang, Bridgewater, NJ (US); Frank C. Wang, Annandale, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 747 days.

(21) Appl. No.: 12/288,566

(22) Filed: Oct. 21, 2008

(65) Prior Publication Data

US 2009/0159427 A1 Jun. 25, 2009

Related U.S. Application Data

(60) Provisional application No. 61/008,414, filed on Dec. 20, 2007.

(51) Int. Cl.
*C10G 45/00* (2006.01)
*C25B 3/00* (2006.01)
*B01D 17/06* (2006.01)

(52) U.S. Cl. ..... 208/57; 205/422; 205/463; 205/695; 205/696

(58) Field of Classification Search ..... 205/422, 205/463, 688, 695, 696; 208/57
See application file for complete search history.

(56) References Cited

U.S. PATENT DOCUMENTS 1,642,624 A 9/1927 Northrup
1,998,849 A 4/1935 Schulze
2,504,058 A 4/1950 Unschuld et al.
3,409,520 A 11/1968 Bolmer
3,546,105 A 12/1970 Jaffe
3,788,978 A 1/1974 Bearden, Jr. et al.
3,915,819 A * 10/1975 Bell et al. ..... 205/696
4,043,881 A 8/1977 Yen et al.
4,043,885 A 8/1977 Yen et al.
4,045,313 A 8/1977 Yen et al.
4,066,739 A 1/1978 Chen
4,081,337 A 3/1978 Spitzer
4,204,923 A 5/1980 Carpenter
4,260,394 A 4/1981 Rich
4,362,610 A 12/1982 Carpenter
4,371,507 A 2/1983 Farha, Jr. et al.
4,849,094 A 7/1989 Shmeleva et al.

(Continued)

FOREIGN PATENT DOCUMENTS

CN 1699519 A 5/2004

OTHER PUBLICATIONS

Sunderland, "Impact of Future Fuel Specifications on Bitumen Upgrading", Proceedings of the World Petroleum Congress (no month, 2000), 16$^{th}$ (vol. 3), pp. 70-77.*

(Continued)

*Primary Examiner* — Edna Wong
(74) *Attorney, Agent, or Firm* — Bruce M. Bordelon

(57) ABSTRACT

This invention relates to the partial hydrogenation of sulfur containing petroleum feedstreams by electrochemical means. The partially hydrogenated feedstream is then conducted to processes for either conversion and removal of at least some of the sulfur-containing species from the electrochemical desulfurization process or adsorption and removal of at least some of the sulfur-containing species from the electrochemical desulfurization process.

11 Claims, 6 Drawing Sheets

U.S. PATENT DOCUMENTS

| | | | | |
|---|---|---|---|---|
| 4,920,015 | A | 4/1990 | Sammells | |
| 4,954,229 | A | 9/1990 | Kim et al. | |
| 5,391,278 | A | 2/1995 | Honna et al. | |
| 5,514,252 | A | 5/1996 | Kerby, Jr. et al. | |
| 5,578,189 | A | 11/1996 | Joshi | |
| 5,879,529 | A | 3/1999 | Greaney et al. | |
| 5,935,421 | A | 8/1999 | Brons et al. | |
| 6,132,590 | A | 10/2000 | Moran et al. | |
| 6,238,530 | B1 | 5/2001 | Yoshida et al. | |
| 6,241,871 | B1 | 6/2001 | Donini et al. | |
| 6,274,026 | B1 | 8/2001 | Schucker et al. | |
| 6,338,788 | B1 | 1/2002 | Schucker | |
| 6,368,495 | B1 | 4/2002 | Kocal et al. | |
| 6,402,940 | B1 | 6/2002 | Rappas | |
| 6,497,973 | B1 | 12/2002 | Amendola | |
| 6,824,673 | B1 * | 11/2004 | Ellis et al. | 208/58 |
| 6,877,556 | B2 | 4/2005 | Wittle et al. | |
| 7,244,351 | B2 | 7/2007 | Baez et al. | |
| 2003/0102123 | A1 | 6/2003 | Wittle et al. | |
| 2005/0161217 | A1 | 7/2005 | Wittle et al. | |
| 2006/0102523 | A1 | 5/2006 | Baez et al. | |
| 2006/0254930 | A1 | 11/2006 | Martinie et al. | |
| 2007/0108101 | A1 | 5/2007 | Baez et al. | |
| 2007/0175798 | A1 | 8/2007 | Fokema et al. | |
| 2009/0145806 | A1 * | 6/2009 | Hamad | 208/142 |

OTHER PUBLICATIONS

Knudsen et al., "Catalyst and Process Technologies for Ultra Low Sulfur Diesel", Applied Catalysis A: General (no month, 1999), vol. 189, pp. 205-215.*

Mossner, "Determination of Polycyclic Aromatic Sulfur Heterocycles in Fossil Fuel-Related Samples", Anal. Chem. (no month, 1999), pp. 58-69.*

A. M. Aitani, M. F. Ali, H. H. Al-Ali; "A Review of non-conventional methods for the desulfurization of residual fuel oil," Petroleum Science and Technology, 18(5&6), 537-553 (2000).

Cesar Ovalles, Iraima Rojas, Socrates Acevedo, Gaston Escobar, Gilberto Jorge, Luis B. Gutierrez, Alfredo Rincon, Benjamin Scharifker; "Upgrading of Orinoco Belt crude oil and its fractions by an electrochemical system in the presence of protonating agents," Fuel Processing Technology 48 (1996) 159-172.

N. Ignat'ev et al., New Ionic Liquids with Tris(Perfluoroalkyl)Trifluorophosphate (FAP) Anions, 126 J. Fluorine Chem., 1150-1159 (2005).

* cited by examiner

PARTIAL ELECTRO-HYDROGENATION OF SULFUR CONTAINING FEEDSTREAMS FOLLOWED BY SULFUR REMOVAL

This Application claims the benefit of U.S. Provisional Application No. 61/008,414 filed Dec. 20, 2007.

FIELD OF THE INVENTION

This invention relates to the partial hydrogenation of sulfur containing petroleum feedstreams by electrochemical means. The partially hydrogenated feedstream is then conducted to processes for either conversion and removal of at least some of the sulfur-containing species from the electrochemical desulfurization process or adsorption and removal of at least some of the sulfur-containing species from the electrochemical desulfurization process.

BACKGROUND OF THE INVENTION

The sulfur content of petroleum products is continuing to be regulated to lower and lower levels throughout the world. Sulfur specifications in gasoline and diesel have been most recently reduced and future specifications will further lower the allowable sulfur content of fuel oils and heating oils. Sulfur is currently removed from petroleum feedstreams by various processes depending on the nature of the feedstream. Processes such as coking, distillation, and alkali metal dispersions are primarily used to remove sulfur from heavy feedstreams, such as bitumens which are complex mixtures and typically contain hydrocarbons, heteroatoms, and metals, with carbon chains in excess of about 2,000 carbon atoms. For lighter petroleum feedstreams such as distillates, catalytic hydrodesulfurization is typically used. The sulfur species in such feedstreams span a range of molecular types from sulfides, thiols, thiophenes, benzothiophenes to dibenzothiophenes in order of decreasing hydrodesulfurization (HDS) reactivity. The most difficult to remove sulfur is found in sterically hindered dibenzothiophene ("DBT") molecules such as diethyl dibenzothiophene. The space velocity, temperature and hydrogen pressures of catalytic HDS units are determined primarily by the slow reaction kinetics of these relatively minor components of the feed. These are the molecules that are typically left in the product after conventional low-pressure hydrotreating. Removing these molecules often requires higher hydrogen pressure and higher temperature ("deep desulfurization") which leads to higher hydrogen consumption and shorter catalyst run lengths, which are costly results. Therefore it is desirable to have alternative processes that are capable of removing these refractory sulfur molecules without incurring more severe reaction conditions for catalytic hydrotreating, which could result in significant capital and energy savings.

SUMMARY OF THE INVENTION

In accordance with a preferred embodiment of the present invention there is provided a process for removing sulfur from a sulfur-containing petroleum feedstream having at least a portion of its sulfur in the form of hindered dibenzothiophene compounds, comprising:

a) forming a mixture of an effective amount of water and said sulfur-containing petroleum feedstream;

b) passing said mixture to an electrochemical cell;

c) subjecting said mixture to an effective voltage and current that will result in the partial hydrogenation of at least a fraction of said hindered dibenzothiophene compounds to hydrogenated naphthenobenzothiophene compounds, thereby resulting in a partially-hydrogenated petroleum feedstream;

d) hydrodesulfurizing at least a portion of said partially-hydrogenated petroleum feedstream by contacting the partially-hydrogenated petroleum feedstream with a hydrodesulfurization catalyst in the presence of hydrogen at hydrodesulfurization conditions, thereby resulting in a reduced-sulfur petroleum product stream and hydrogen sulfide; and e) separating the hydrogen sulfide from said reduced-sulfur petroleum product stream;

wherein the reduced-sulfur petroleum product stream has a lower sulfur content by wt % than the sulfur-containing petroleum feedstream.

In another preferred embodiment the sulfur-containing petroleum feedstream is comprised of a bitumen.

In another preferred embodiment the sulfur-containing petroleum feedstream is a distillate boiling range stream and an effective amount of an electrolyte is mixed with the mixture of water and distillate boiling range stream.

Also in accordance with another preferred embodiment of the present invention there is provided a process for removing sulfur from a sulfur-containing petroleum feedstream wherein at least a portion of the sulfur is in the form of hindered dibenzothiophene compounds, comprising:

a) forming a mixture of an effective amount of water and a sulfur-containing petroleum feedstream;

b) passing said mixture to an electrochemical cell;

c) subjecting said mixture to an effective voltage and current that will result in the partial hydrogenation of at least a fraction of said hindered dibenzothiophene compounds to hydrogenated naphthenobenzothiophene compounds, thereby resulting in a partially-hydrogenated petroleum feedstream;

d) passing said partially-hydrogenated petroleum feedstream to an adsorption zone containing an adsorbent wherein at least a portion of the partially-hydrogenated sulfur species is adsorbed, thereby resulting in a reduced-sulfur petroleum product stream; and e) collecting said reduced-sulfur petroleum product stream;

wherein the reduced-sulfur petroleum product stream has a lower sulfur content by wt % than the sulfur-containing petroleum feedstream.

DETAILED DESCRIPTION OF THE INVENTION

Feedstreams suitable for use in the present invention range from heavy oil feedstreams, such as bitumens to those boiling in the distillate range all of which are covered herein by the term "sulfur-containing petroleum feedstream". In a preferred embodiment the heavy oil feedstream contains at least about 10 wt. %, preferably at least about 25 wt. % of material boiling above about 1050° F. (565° C.), both at atmospheric pressure (0 psig). Such streams include bitumens, heavy oils, whole or topped crude oils and residua. The bitumen can be whole, topped or froth-treated bitumen. Non-limiting examples of distillate boiling range streams that are suitable for use herein include diesel fuels, jet fuels, heating oils, kerosenes, and lubes. Such streams typically have a boiling range from about 302° F. (150° C.) to about 1112° F. (600° C.), preferably from about 662° F. (350° C.) to about 1022° F. (550° C.). Other preferred streams are those typically known as the Low Sulfur Automotive Diesel Oil ("LSADO"). LSADO will typically have a boiling range of about 350° F. (176° C.) to about 550° F. (287° C.) and contain from about 200 wppm sulfur to about 2 wppm sulfur, preferably from about 100 wppm sulfur to about 10 wppm sulfur. The process embodiments of the present invention electrochemically treat a sulfur-containing petroleum feedstream resulting in a reduced-sulfur petroleum product stream which has a lower sulfur concentration by wt % than the sulfur-containing petroleum feedstream.

The major sulfur component of distillates, such as diesel oils, are hindered dibenzothiophene molecules. Although such molecules are difficult to remove by conventional hydrodesulfurization processes without using severe conditions, such as high temperatures and pressures, such molecules are converted by the practice of the present invention to sulfur species that are more easily removed by conventional non-catalytic processes. For example, the electrochemical step of the present invention converts at least a portion of the hindered dibenzothiophene molecules in the feedstream, which are substantially refractory to conventional hydrodesulfurization, into hydrogenated naphthenobenzothiophene mercaptan molecules that are more readily extracted with use of caustic solution or by thermal decomposition. This capability can significantly debottleneck existing distillate hydrotreating process units by converting the slowest to convert molecules (hindered dibenzothiophenes) into much more readily extractable mercaptan species, preferably alkylated biphenyl mercaptan species.

Figure 1:
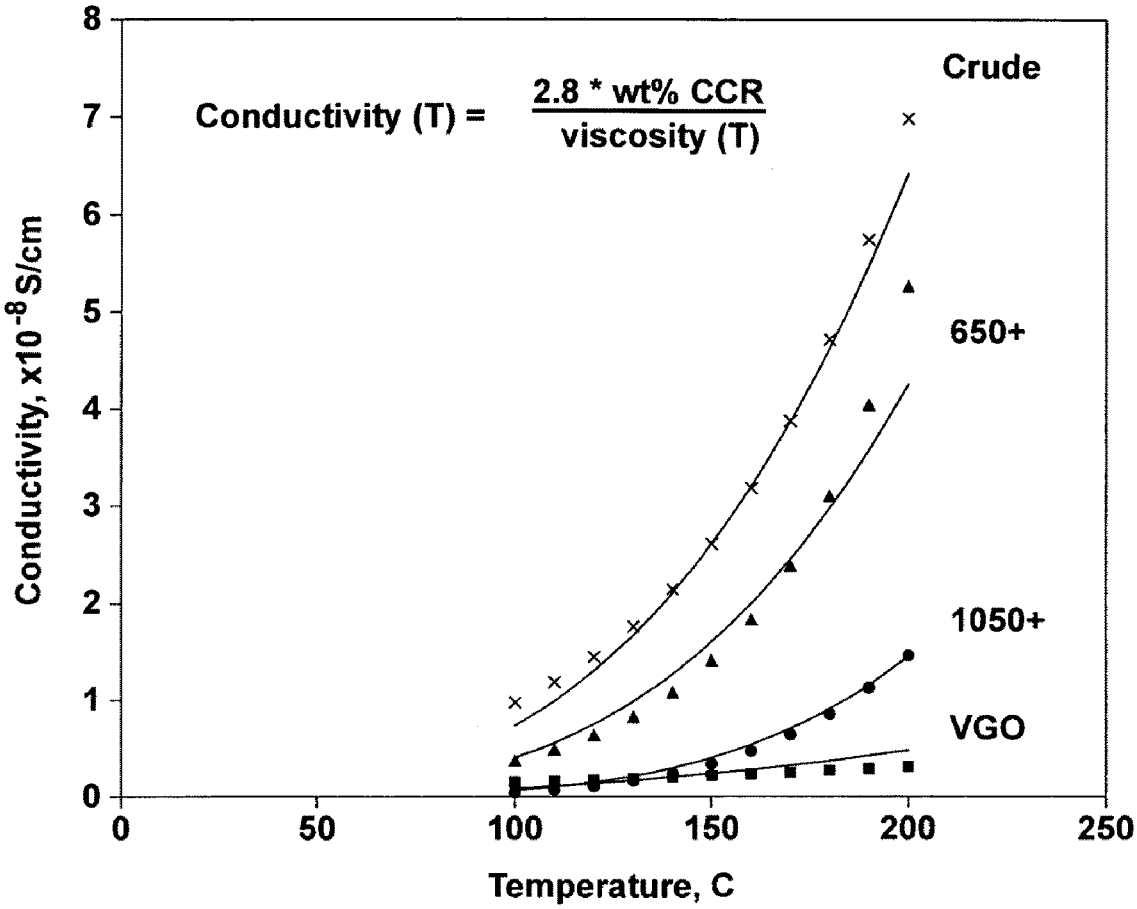
FIG. 1 hereof is a plot of conductivity versus temperature for various distillation cuts of a petroleum crude.

The process of the present invention does not require the addition of an electrolyte when a heavy oil is the feedstream, but rather, relies on the intrinsic conductivity of the heavy oil at elevated temperatures. It will be understood that the term "heavy oil" and "heavy oil feedstream" as used herein includes both bitumen and other heavy oil feedstreams, such as crude oils, atmospheric resids, and vacuum resids. This process is preferably utilized to upgrade bitumens and/or crude oils that have an API gravity less than 15. The inventors hereof have undertaken studies to determine the electrochemical conductivity of crudes and residues (which includes bitumen and heavy oils) at temperatures up to about 572° F. (300° C.) and have demonstrated an exponential increase in electrical conductivity with temperature as illustrated in FIG. 1 hereof. It is believed that the electrical conductivity in crudes and residues is primarily carried by electron-hopping in the π-orbitals of aromatic and heterocyclic molecules. Experimental support for this is illustrated by the simple equation, shown in FIG. 1 hereof, that can be used to calculate the conductivity of various cuts of a crude using only its temperature dependent viscosity and its Conradson carbon (Concarbon) content. The molecules that contribute to Concarbon are primarily the large multi-ring aromatic and heterocyclic components.

A 4 mA/cm$^2$ electrical current density at 662° F. (350° C.) with an applied voltage of 150 volts and a cathode-to-anode gap of 1 mm was measured for an American crude oil. Though this is lower than would be utilized in preferred commercial embodiments of the present invention, the linear velocity for this measurement was lower than the preferred velocity ranges by about three orders of magnitude: 0.1 cm/s vs. 100 cm/s. Using a 0.8 exponent for the impact of increased flow velocity on current density at an electrode, it is estimated that the current density would increase to about 159 mA/cm$^2$ at a linear velocity of about 100 cm/s. This suggests that more commercially attractive current densities achieved at higher applied voltages. Narrower gap electrode designs or fluidized bed electrode systems could also be used to lower the required applied voltage.

Unlike bitumen, performing controlled potential electrolysis on a non-conductive fluid such as a LSADO, or other petroleum distillate streams, requires the introduction of an effective amount of an electrolyte, such as a conductive salt. There is an insufficient concentration of large multi-ring aromatic and heterocyclic molecules in distillate boiling range feedstreams to produce sufficient intrinsic conductivity without the use of an electrolyte. The direct addition of a conductive salt to the distillate feedstream can be difficult for several reasons. The term "effective amount of electrolyte" as used herein means at least than amount needed to produce conductivity between the anode and the cathode of the electrochemical cell. Typically this amount will be from about 0.5 wt. % to about 50 wt. %, preferably from about 0.5 wt. % to about 10 wt. %, of added electrolytic material based on the total weight of the feed plus the electrolyte. Once dissolved in the oil, most salts are difficult to remove after electrolysis. Incomplete salt removal is unacceptable due to product specifications, negative impact on further catalytic processing, potential corrosivity and equipment fouling. Even salts that are soluble in a low dielectric medium are often poorly ionized and therefore unacceptable high concentrations are required to achieve suitable conductivities. In addition, such salts are typically very expensive. However, recent advances in the field of ionic liquids have resulted in new organic soluble salts having melting points lower than about 212° F. (100° C.) that can be used in the present invention. They can be recovered by solvent washing the petroleum stream after electrolysis. Non-limiting examples of such salts include: 1-butyl-1-methylpyrrolidinium tris(pentafluoroethyl)trifluoro phosphate, 1-butyl-1-methylpyrrolidinium trifluoro-methyl sulfonated, trihexyltetradecylphosphonium tris(pentafluoroethyl) trifluorophosphate and ethyl-dimethylpropyl-ammonium bis (trifluoro-methylsulfonyl) imide.

An alternate solution to the low conductivity problem of distillate boiling range feedstreams is to produce a two phase system. Rather than adding an electrolyte to the feedstream, the feedstream can be dispersed in a conductive, immiscible, non-aqueous electrolyte. Such a two-phase system of oil dispersed in a continuous conductive phase provides a suitable electrolysis medium. The continuous conductive phase provides the sufficient conductivity between the cathode and anode of an electrochemical cell to maintain a constant electrode potential. Turbulent flow through the electrochemical cell brings droplets of the feedstream in contact with the cathode, at which point electrons are transferred from the electrode to sulfur containing species on the droplet surface.

For ease of separation following electrolysis, dispersions are preferred. However, more stable oil-in-solvent emulsions can also be used. Following electrolytic treatment, the resulting substantially stable emulsion can be broken by the addition of heat and/or a de-emulsifying agent.

After reaction, the immiscible electrolyte from the treated feedstream is separated by any suitable conventional means resulting in a reduced sulfur product stream. The immiscible electrolyte can be recycled. The electrolyte in the immiscible electrolysis medium is preferably an electrolyte that dissolves, or dissociates, in the solvent to produce electrically conducting ions, but that does not undergo a redox reaction in the range of the applied potentials used. Suitable organic electrolytes for use in the present invention, other than those previously mentioned, include quaternary carbyl- and hydrocarbyl-onium salts, e.g., alkylammonium hydroxides. Non-limiting examples of inorganic electrolytes include, e.g., NaOH, KOH and sodium phosphates, and mixtures thereof. Non-limiting examples of onium ions that can be used in the practice of the present invention include mono- and bis-phosphonium, sulfonium and ammonium, preferably ammonium. Preferred carbyl and hydrocarbyl moieties are alkyl carbyl and hydrocarbyl moieties. Suitable quaternary alkyl ammonium ions include tetrabutyl ammonium, and tetrabutyl ammonium toluene sulfonate. Optionally, additives known in the art to enhance performance of the electrodes can also be used. Non-limiting examples of such additives suitable for use herein include surfactants, detergents, emulsifying agents and anodic depolarizing agents. Basic electrolytes are most preferred. The concentration of salt in the electrolysis medium should be sufficient to generate an electrically conducting solution in the presence of the feedstream. Typically, a concentration of about 1 to about 50 wt % conductive phase, preferably about 5 to about 25 wt % based on the overall weight of the oil/water/electrolyte mixture is suitable. It is preferred that petroleum stream immiscible solvents be chosen, such as dimethyl sulfoxide, dimethylformamide or acetonitrile.

The electrochemistry of the present invention can be performed on a heavy oil feedstream at about ambient temperature of about 77° F. to about 257° F. (25° C. to 125° C.) and at substantially atmospheric pressure and without the use of an electrolyte or gaseous hydrogen. An electrolyte will be needed when the feedstream is a distillate (or similar in composition to a distillate such as a naphtha) because such feedstreams do not have the inherent conductivity that is found in bitumen and other heavy feeds. The present invention does not produce a waste stream of extracted sulfur species, but rather the sulfur is converted to hydrogen sulfide in a downstream hydrodesulfurization process unit. Hydrogen for the present invention is derived from water. In general, the process of the present invention is conducted by mixing an effective amount of water with a sulfur-containing petroleum stream to be treated. By "effective amount of water" we mean that minimum amount of water needed to supply protons for the electrohydrogenation of the feed. That is, that minimum amount of water needed to result in the reduction of sulfur in the feed by at least about 90%, and preferably at least about 95%. This effective amount of water will typically range from about 0.1 wt. % to about 90 wt. %, preferably from about 0.5 wt. % to about 5 wt. % of the overall hydrocarbon/water mixture.

The mixture of water and petroleum feedstream to be treated are introduced into an electrochemical cell and subjected to an effective electrical voltage and current. Any suitable electrochemical cell can be used in the practice of the present invention. For example, the cell may be divided or undivided. Such systems include stirred batch or flow through reactors. The foregoing may be purchased commercially or made using technology known in the art. Suitable electrodes known in the art may be used. Included as suitable electrodes are three-dimensional electrodes, such as carbon or metallic foams. The optimal electrode design would depend upon normal electrochemical engineering considerations and could include divided and undivided plate and frame cells, bipolar stacks, fluidized bed electrodes and porous three dimensional electrode designs; see *Electrode Processes and Electrochemical Engineering* by Fumio Hine (Plenum Press, New York 1985). While direct current is typically used, electrode performance may be enhanced using alternating current or other voltage/current waveforms.

The applied cell voltage, that is, the total voltage difference between the cathode and anode will vary depending upon the cell design and electrolytes used. The electrochemical cell can be divided or undivided and is preferably comprised of parallel thin steel sheets mounted vertically within a standard pressure vessel shell. The gap between electrode surfaces will preferably be about 1 to about 50 mm, more preferably from about 1 to about 25 mm, and the linear velocity will be in the range of about 1 to about 500 cm/s, more preferably in the range of about 50 to about 200 cm/s. Electrical contacts are only made to the outer sheets. The electrode stack can be polarized with about 4 to about 500 volts, preferably from about 100 to about 200 volts, resulting in a current density of about 10 $mA/cm^2$ to about 1000 $mA/cm^2$ preferably from about 100 $mA/cm^2$ to about 500 $mA/cm^2$. It will be noted that other commercial cell designs, such as a fluidized bed electrode can also be used in the practice of the present invention. What is critical, however, is that the cathode be polarized sufficiently to achieve electron transfer to the dibenzothiophene molecules, which occurs at reduction potentials more negative than −2.3 Volts versus a standard calomel electrode. Normal electrochemical practices can be used to ensure that the cell is operated under these conditions.

At least a portion of the hindered dibenzothiophene compounds in the feedstream are partially hydrogenated to the corresponding hydrogenated naphthenobenzothiopene compounds. In one embodiment, the treated feedstream is then passed to a conventional hydrodesulfurization zone wherein at least a portion of the sulfur is converted to hydrogen sulfide, which is separated from the reaction products. The hydrogen sulfide can then be passed to a Claus plant to produce elemental sulfur. The Claus process is well known in the art and is a significant gas desulfurizing processes for recovering elemental sulfur from gaseous hydrogen sulfide. Typically gaseous streams containing at least about 25% hydrogen sulfide are suitable for a Claus plant. The Claus process is a two step process, thermal and catalytic. In the thermal step, hydrogen sulfide-laden gas reacts in a substoichiometric combustion at temperatures above about 1562° F. (850° C.) such that elemental sulfur precipitates in a downstream process gas cooler. The Claus reaction continues in a catalytic step with activated alumina or titanium dioxide, and serves to boost the sulfur yield.

Suitable hydrodesulfurization catalysts for use in the present invention are any conventional hydrodesulfurization catalyst used in the petroleum and petrochemical industries. A common type of such catalysts are those comprised of at least one Group VIII metal, preferably Fe, Co and Ni, more preferably Co and/or Ni, and most preferably Co; and at least one Group VI metal, preferably Mo and W, more preferably Mo, on a high surface area support material, such as alumina, silica alumina, and zeolites. The Group VIII metal is typically present in an amount ranging from about 2 to 20 wt. %, preferably from about 4 to 12%. The Group VI metal will typically be present in an amount ranging from about 5 to 50 wt. %, preferably from about 10 to 40 wt. %, and more preferably from about 20 to 30 wt. %. All metal weight percents are on support. By "on support" we mean that the percents are based on the weight of the support. For example, if the support were to weigh 100 g. then 20 wt. % Group VIII metal would mean that 20 g. of Group VIII metal was on the support. Typical hydrodesulfurization temperatures will be from about 212° F. (100° C.) to about 842° F. (450° C.) at pressures from about 50 psig to about 3,000 psig.

Other suitable hydrotreating catalysts include noble metal catalysts such as those where the noble metal is selected from Pd, Pt, Pd and Pt, and bimetallics thereof. It is within the scope of the present invention that more than one type of hydrotreating catalyst be used in the same bed.

Non-limiting examples of suitable support materials that can be used for the catalysts of the present invention include inorganic refractory materials, such as alumina, silica, silicon carbide, amorphous and crystalline silica-aluminas, silica magnesias, alumina-magnesias, boria, titania, zirconia and mixtures and cogels thereof. Preferred support materials include alumina, amorphous silica-alumina, and the crystalline silica-aluminas, particularly those materials classified as clays or zeolites. The most preferred crystalline silica-aluminas are controlled acidity zeolites modified by their manner of synthesis, by the incorporation of acidity moderators, and post-synthesis modifications such as dealumination.

Instead of hydrodesulfurizing the partially hydrogenated feedstream, after electrochemical treatment, it can alternatively be sent to an absorption zone where it comes into contact with a suitable adsorbent. Preferred adsorbents are sulfur attracting metal-based adsorbents. Non-limiting of examples of metals that can be used in the practice of the present invention include silver, lead, copper, zinc, iron, nickel, cobalt, molybdenum, cerium, and lanthanum. The aforementioned metals supported on alumina or silica, are also suitable for use herein. Other suitable adsorbents include non metal-based adsorbents, such as carbon-based or zeolitic materials. Also, the sorbent can be in the form of a packed-bed, fluidized bed, moving bed, and rapid cycle pressure swing adsorber, and the like. By partially hydrogenating the DBTs, they now become susceptible to a wide variety of adsorbent materials and associated adsorption processes. For purposes of this invention the adsorbent will be discussed in terms of one of the more preferred adsorbent metal which is silver (Ag+). The adsorption zone will generally be operated at temperatures of about 77° F. (25° C.) to about 257° F. (125° C.) and about atmospheric pressure.

If a molecule contains a sulfur atom, the form of sulfur bonding in the hydrocarbon molecule will affect the absorption/interaction with the silver (Ag+) ion. If the sulfur bonding in the hydrocarbon molecule is "aliphatic" in type, (such as a mercaptan or a sulfide), the extra electron pair in the d-orbital of sulfur atom will still available for absorption/interaction. On the adsorbent side, the silver (Ag+) ion has just have an empty d-orbital available for interaction/association, so, the absorption/interaction between "aliphatic" type sulfur and the silver (Ag+) ion will be "strong". In contrast, if the sulfur bonding in the molecule is "aromatic" in type, (such as a thiophene, a benzothiophene, or a dibenzothiophene), that means that the sulfur atom is part of "aromatic" ring structure. In this instance, the extra electron pair in the d-orbital of sulfur atom has been used for aromaticities of the molecule, it is not available for absorption/interaction anymore. Therefore, the absorption/interaction between "aromatic" type sulfur molecules to the silver (Ag+) ion will be "weak". One can use this difference in degree of absorption/interaction with silver (Ag+) ion to distinguish the sulfur bonding type in a molecule.

The present invention will be better understood with reference to the following examples which are presented for illustrative purposes and are not to be taken as limiting the invention in anyway.

Example 1

Electrochemical Treatment of LSADO

A Low Sulfur Automotive Diesel Oil ("LSADO") was chosen for the following examples. It had an API gravity of 36, a 462 wppm sulfur content (primarily of dibenzothiophenic sulfur species) and a 66 wppm nitrogen content. The electrochemical cell used in these examples was a divided electrochemical cell wherein the cathode and anode solutions were separated by a fine glass frit ion-permeable barrier. A conventional H-shaped cell was used. The electrolyte solution was comprised of 75 milliliters ("ml") of tetrahydrofuran, 4.5 grams of tetrabutylammonium hexafluorophosphate ($TBAPF_6$) and 5 grams of water. The volume of the catholyte chamber was approximately 50 ml and to this was added one ml of LSADO. A mercury pool cathode was employed, with slow nitrogen bubbling to sweep air from the solution prior to the run. The anode chamber has a volume of 25 mls and was fitted with a platinum flag electrode. The reduction potential of the mercury pool was controlled with a Princeton Applied Research #173 Potentiostat with a standard calomel reference electrode. The reduction was conducted at −2.65 Volts vs. SCE, which was sufficient to reduce the hindered dibenzothiophene molecules in the LSADO. The reduction was conducted for 16 hours at room temperature. After the run, one gram of sodium sulfate was added to the catholyte solution to react with the water that was added, then the tetrahydrofuran was evaporated under a nitrogen sweep. Once dry, the salt (TBAP and $Na_2SO_4.xH_2O$) mixture was extracted with 60 mls of diethyl ether to extract away the treated LSADO. This was concentrated by evaporation and then analyzed by comprehensive two-dimensional gas chromatography (2D GC).

Example 2

2DGC (GC×GC) Measurement of Sulfur-Containing Compounds in LSADO Before and after Electrochemical Treatment The 2D GC (GC×GC) system was a Pegasus 4D manufactured by LECO Corp. (St. Joseph, Mich., USA) and consisted of an Agilent 6890 gas chromatograph (Agilent Technology, Wilmington, Del.) configured with inlet, columns, and detectors. A split/splitless inlet system with a 100-vial tray autosampler was used. The two-dimensional capillary column system utilized a non-polar first column (BPX-5, 30 meter, 0.25 mm I.D., 1.0 μm film), and a polar (BPX-50, 3 meter, 0.25 mm I.D., 0.25 μm film), second column. Both capillary columns were the products of SGE Inc. Austin, Tex. A dual jet thermal modulation assembly based on Zoex technology (Zoex Corp. Lincoln, Nebr.) which is a liquid nitrogen cooled "trap-release" dual jet thermal modulator was installed between these two columns. A flame ionization detector (FID) and a sulfur chemiluscence detector (SCD) (GE analytical Inc.) were used for the signal detection. A 1.0 microliter sample was injected with 75:1 split at 572° F. (300° C.) from the inlet system. Carrier gas flow was 1.0 ml per minute. The oven was programmed from 60° C. with 0-minute hold and 3° C. per minute increment to 572° F. (300° C.) with 0-minute hold. The total GC run time was 80 minutes. The modulation period was 10 seconds. The sampling rate for the detector was 100 Hz. After data acquisition, it was processed for qualitative and quantitative analysis software package that came with the GC. A display-quality chromatogram was accomplished by converting data to a two-dimensional image that was processed by a commercial program ("Transform" (Research Systems Inc. Boulder, Colo.)). The two-dimensional image was further treated by "PhotoShop" program (Adobe System Inc., San Jose, Calif.) to generate publication-ready images.

Figure 2:
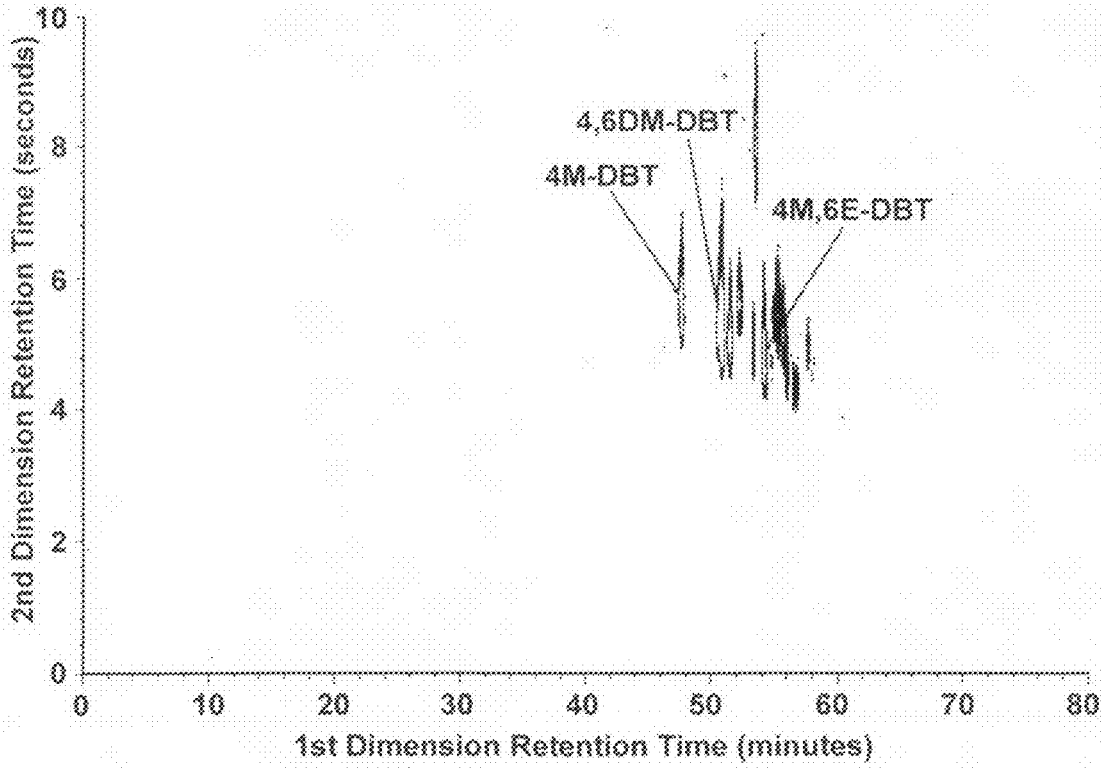
FIG. 2 is a 2DGC (GC×GC) chromatogram of untreated low sulfur automobile diesel oil (LSADO). The sulfur-containing compounds in the sample were mostly of hindered alkyl dibenzothiophenes which are referred as the "hard" or "refractory" compounds.

A first chromatogram (FIG. 2 hereof) was obtained and showed that sulfur containing compounds in this sample were shown to be predominantly of hindered alkyl dibenzothiophenes which are referred as the "hard" or "refractory" compounds.

Figure 3:
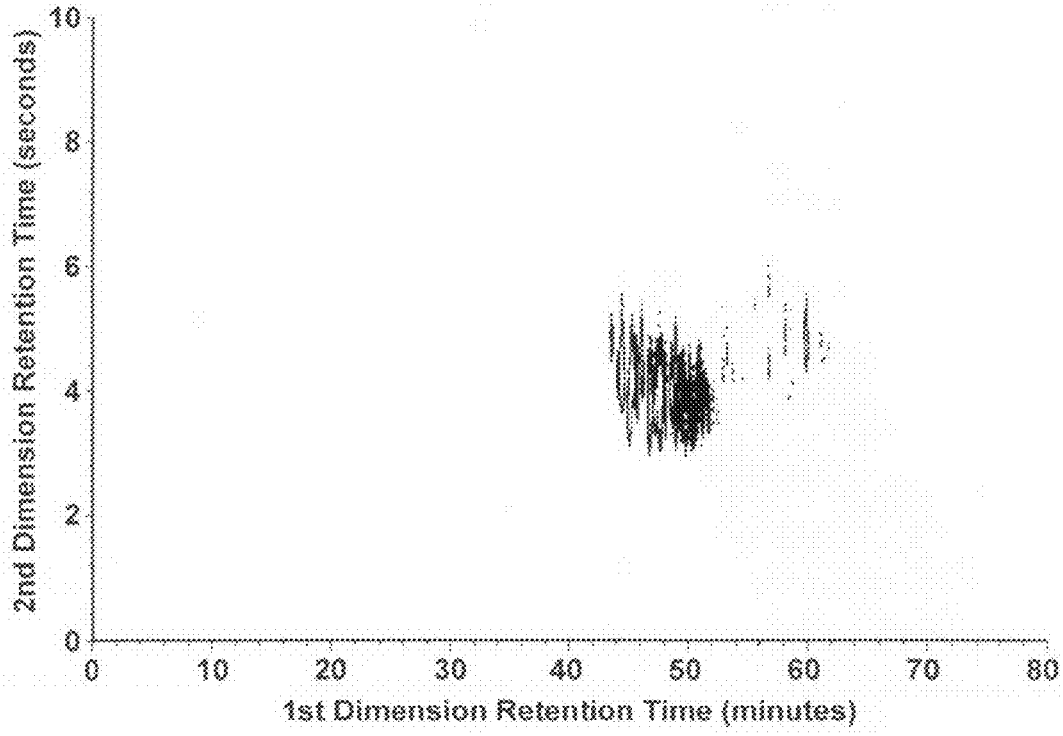
FIG. 3 is a 2DGC (GC×GC) chromatogram of the electrochemically treated LSADO. The molecular structure of the sulfur-containing compounds were changed in the sample based on the polarity difference which is reflected in the Y-axis position in the 2DGC chromatogram.

A second chromatogram (FIG. 3 hereof) of the electrochemically treated LSADO was obtained and showed that the molecular structure of sulfur containing compounds had changed in the sample based on the polarity difference which was reflected in the Y-axis position in the 2DGC chromatogram.

Figure 4:
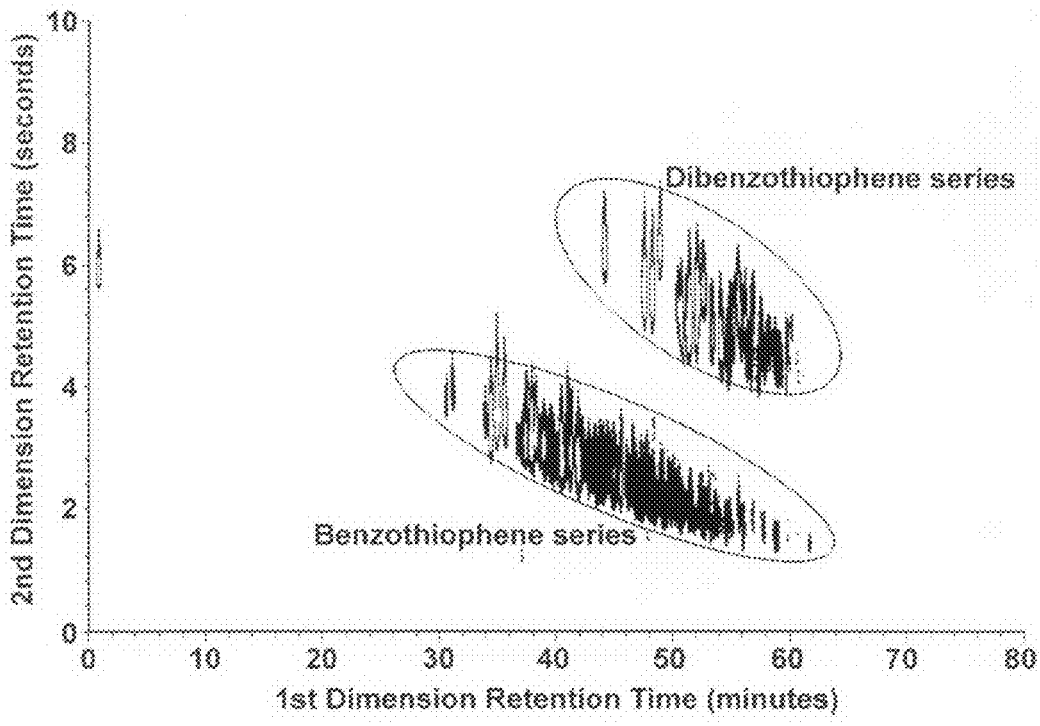
FIG. 4 is a 2DGC (GC×GC) chromatogram of a typical diesel sample containing a complete series of benzothiophene and dibenzothiophene compounds. This chromatogram is used as a standard sulfur-containing compound reference to define the qualitative analysis as well as the relative polarity retention position of each compound class in the 2DGC (GC×GC) analysis.

A third chromatogram (FIG. 4 hereof) was obtained of a typical diesel sample consisting of a complete series of benzothiophene and dibenzothiophene compounds. This chromatogram was used as a standard sulfur-containing compound reference to define the qualitative analysis as well as the relative polarity retention position of each compound class in the 2DGC (GC×GC) analysis.

Figure 5:
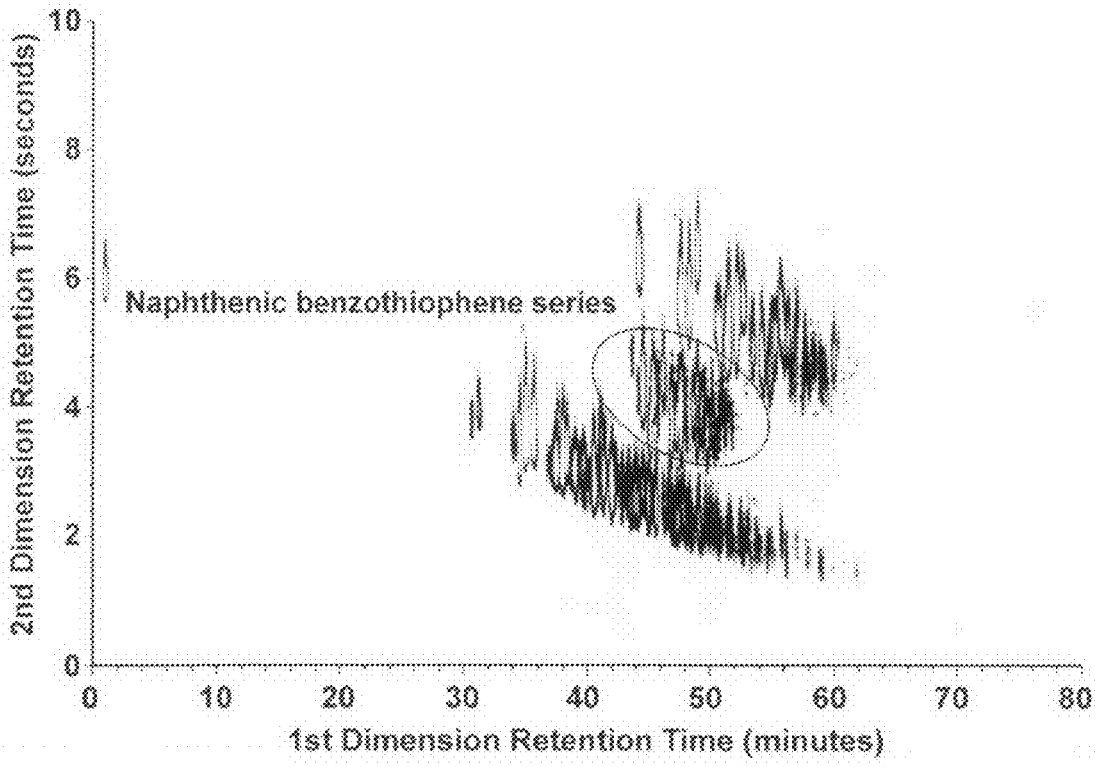
FIG. 5 is a synthesized chromatogram that superimposed FIG. 3 and FIG. 4. It demonstrates that the polarity of sulfur-containing compounds in LSADO after the electrochemical treatment is between benzothiophenes and dibenzothiophenes.

In order to effectively identify the molecular structures of sulfur-containing compounds of the second chromatogram, the second chromatogram (FIG. 3) was superimposed on the third chromatogram (FIG. 4) to deduce the molecular structure based on their relative polarity retention position as well as the structures of benzothiophenes and dibenzothiophenes. The superimposed chromatograms (shown in FIG. 5) demonstrated that the polarity of sulfur-containing compounds in LSADO after the electrochemical treatment of the present invention is in between the benzothiophenes and dibenzothiophenes that were measured in the LSADO feed prior to treatment. Based on the possible structures and aromaticity, this series compounds was assigned as naphthenic benzothiophene series. The possible chemical reaction based on the electrochemical treatment can be expressed as:

[1]

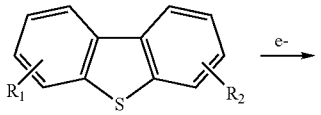

-continued

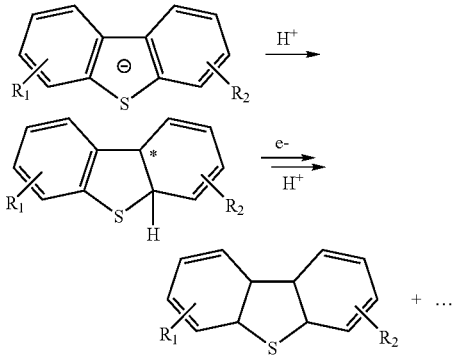

However, it is important to confirm the types of sulfur atoms in electrochemically treated LSADO. There are only two possibilities, either the thiophenic sulfur atom (sulfur atom in the aromatic ring) or non-thiophenic sulfur (sulfur atom not in the aromatic ring). A silver ($Ag^+$) test was used to distinguish the type of the sulfur atom in the second chromatogram. The mechanism of this test was that the lone electron pair on the sulfur atom can bind with Ag+ and be retained on a $Ag^+$ column. In the thiophenic sulfur atom case, the p electrons on the sulfur are engaged in the π orbital of the aromatic structure, so there is no lone electron pair available to interact with $Ag^+$. On the other hand, the non-thiophenic sulfur atom has a lone electron pair, which can interact with the "Lewis acid" $Ag^+$ forming a complex. This test is demonstrated in Example 3 below.

Example 3

Figure 6:
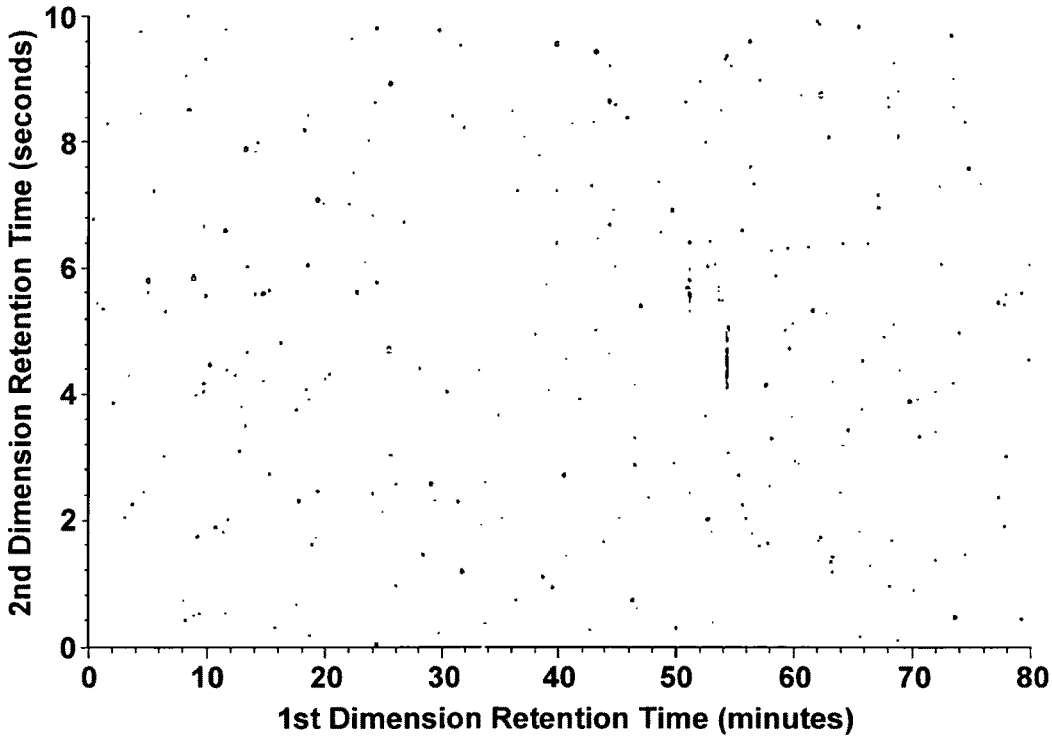
FIG. 6 is a 2DGC (GC×GC) chromatogram of LSADO, after electrochemical treatment and passing through a silver adsorption column. The sulfur-containing compounds appear to be all non-thiophenic sulfur compounds and were removed by the column. This chromatogram only contains random noise and does not show the presence of any benzothiophene compounds.

Adsorption of Sulfur Molecules in the Electrochemically Treated LSADO Using $Ag^+$ Column A silver column ($Ag^+$ supported on alumina) was set-up. The electrochemically treated LSADO in Example 2 above was passed through the column, compounds that contain non-thiophenic sulfur will interact with silver and be adsorbed on the column. Compounds that contain thiophenic sulfur will pass through the column and remain unchanged. When an electrochemically treated LSADO sample was passed through the $Ag^+$ column, all sulfur-containing components interact with silver and were removed by the column (FIG. 6). FIG. 6 presents a 2DGC (GC×GC) chromatogram of the electrochemically treated LSADO passed through the silver column. The chromatogram shows that essentially all of the compounds were adsorbed in the $Ag^+$ column, indicating that all sulfur compounds after electrochemical treatment are converted to compounds that contain non-thiophenic sulfur and were retained on the silver column.

Example 4

Electrochemical Treatment of DBT

A divided electrochemical cell as in Example 1 above was used for this example. The electrolyte solution was comprised of 90 mls of tetrahydrofuran, 9.6 grams of tetrabutylammonium hexafluorophosphate (TBAP) and 10 grams of water. The volume of the catholyte chamber was approximately 75 mls and to this was added 1 g of dibenzothiophene (DBT) (99+% from Aldrich). A mercury pool cathode was employed, with slow nitrogen bubbling to sweep air from the solution prior to the run. The anode chamber had a volume of 25 mls and was fitted with a platinum flag electrode. The reduction potential of the mercury pool was controlled with a Princeton Applied Research #173 Potentiostat with a standard calomel reference electrode. The reduction was conducted at −2.5 Volts vs. SCE, which is sufficient to reduce the DBT. The reduction was conducted for 6 hours at room temperature. After the run, the solution in the cathode chamber was taken out and acidified with 50 mL of 10% HCl in water, then 100 ml of de-ionized ("DI") water was added. Ether (50 ml×3) was used to extract the organic molecules. The ether solution was dried over anhydrous $Na_2SO_4$, and ether was allowed to evaporate under a stream of $N_2$. The isolated dry sample was used for 2DGC analysis.

Example 5

Adsorption of Electrochemically Treated DBT Using $Ag^+$ Column

A silver column ($Ag^+$ supported on alumina) was set-up. The electrochemically treated DBT in Example 1 was passed through the column, compounds that contain non-thiophenic sulfur will interact with silver and are adsorbed on the column. Compounds that contain thiophenic sulfur will pass through the column. Running this sample through a $Ag^+$ column effectively removes all the hydrogenated DBT species (see FIG. 6).

Herein is discovered a process that can easily remove the refractory sulfur species in petroleum streams by an electrochemical treatment in the presence of water, followed by adsorption using $Ag^+$. The adsorbed sulfur species can be washed off the column by rinsing with a solvent such as methanol. The chemistry of conversion of the DBT species to non-thiophenic sulfur species and subsequent adsorption is illustrated as follows.

[2]

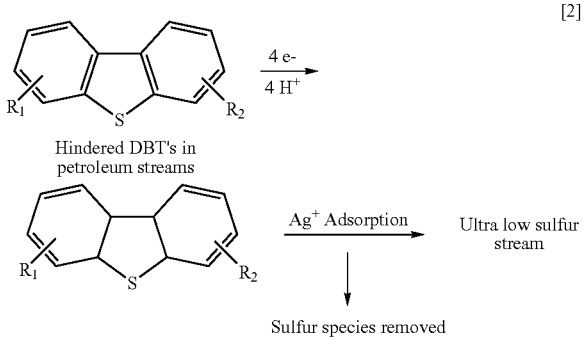

Other adsorbents would also be likely effective in this removal, not just silver. This example is a proof-of-principle that hindered DBTs in LSADO can be converted to a solid adsorbent removable form.

For Examples 6 though 8 herein, a 300-cc autoclave (Parr Instruments, Moline, Ill.) was modified to allow two insulating glands (Conax, Buffalo, N.Y.) to feed through the autoclave head. Two cylindrical stainless steel (316) mesh electrodes are connected to the Conax glands, where the power supply (GW Laboratory DC Power Supply, Model GPR-1810HD) is connected to the other end. The autoclave body is fitted with a glass insert, a thermal-couple and a stirring rod. The autoclave can be charged with desired gas under pressure and run either in a batch mode or a flow-through mode.

Example 6

Electrochemical Treatment of DBT Under $N_2$ in Dimethyl Sulfoxide Solvent with Tetrabutylammonium Hexafluorophosphate Electrolyte To the glass insert was added 1.0 g DBT, 3.87 g tetrabutylammonium hexafluorophosphate ($TBAPF_6$), and 100-mL anhydrous dimethyl sulfoxide (DMSO, Aldrich). After the content is dissolved, the glass insert was loaded into the autoclave body, the autoclave head assembled and pressure tested. The autoclave was charged with 70 psig of $N_2$ and heated to 212° F. (100° C.) with stirring (300 rpm). A voltage of 5 Volts was applied and the current was 0.8 Amp. The current gradually decreased with time and after two hours, the run was stopped. The autoclave was opened and the content acidified with 10% HCl (50 ml). The acidified solution was then diluted with 100 ml of DI water, extracted with ether (50 ml×3). The ether layer was separated and dried over anhydrous $Na_2SO_4$, and ether was allowed to evaporate under a stream of $N_2$. The isolated dry products were analyzed by GC-MS. A conversion of 12% was found for DBT and the products are as the following.

[3]

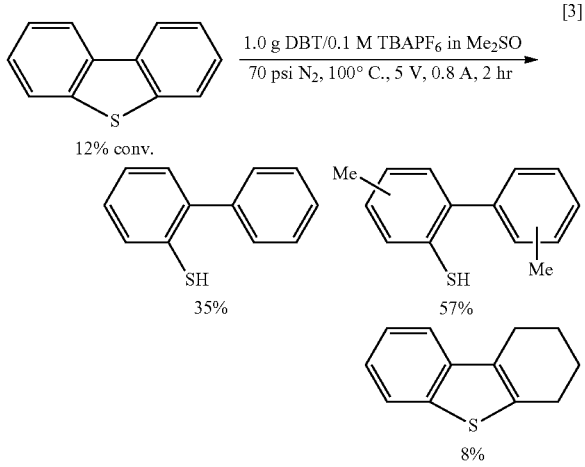

Example 7

Electrochemical Treatment of DBT Under $H_2$ in Dimethyl Sulfoxide Solvent with Tetrabutylammonium Hexafluorophosphate Electrolyte To the glass insert was added 0.5 g DBT, 3.87 g tetrabutylammonium hexafluorophosphate ($TBAPF_6$), and 100-mL anhydrous dimethyl sulfoxide (DMSO, Aldrich). After the content is dissolved, the glass insert was loaded into the autoclave body, the autoclave head assembled and pressure tested. The autoclave was charged with 300 psig of $H_2$ and heated to 257° F. (125° C.) with stirring at about 300 rpm. A voltage of 4.5 Volts was applied and the current was 1.0 Amp. The current gradually decreased with time and after three and half (3.5) hours, the run was stopped. The autoclave was opened and the content acidified with 10% HCl (50 ml). The acidified solution was then diluted with 100 ml of DI water, extracted with ether (50 ml×3). The ether layer was separated and dried over anhydrous $Na_2SO_4$, and ether was allowed to evaporate under a stream of $N_2$. The isolated dry products were analyzed by GC-MS. A conversion of 16.5% was found for DBT and the products are as the following.

[4]

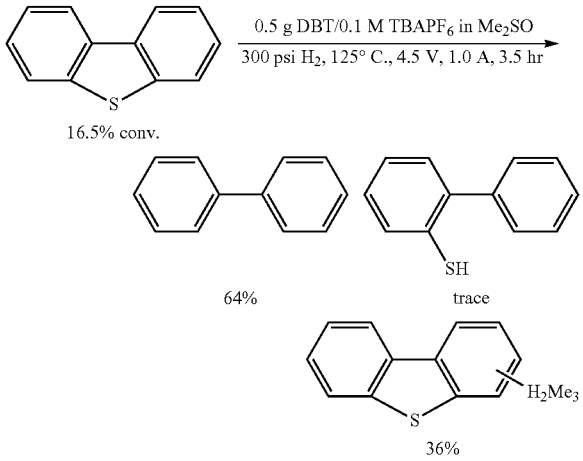

Example 8

Electrochemical Treatment of DEDBT Under $H_2$ in Dimethyl Sulfoxide Solvent with Tetrabutylammonium Hexafluorophosphate Electrolyte To the glass insert was added 1.0 g 4,6-diethyl dibenzothiophene (DEDBT), 3.87 g tetrabutylammonium hexafluorophosphate ($TBAPF_6$), and 100-ml anhydrous dimethyl sulfoxide (DMSO, Aldrich). After the content is dissolved, the glass insert was loaded into the autoclave body, the autoclave head assembled and pressure tested. The autoclave was charged with 200 psig of $H_2$ and heated to 212° F. (100° C.) with stirring (300 rpm). A voltage of 7 Volts was applied and the current was 1.0 Amp. The current gradually decreased with time and after two and half (2.5) hours, the run was stopped. The autoclave was opened and the content acidified with 10% HCl (50 ml). The acidified solution was then diluted with 100 ml of DI water, extracted with ether (50 ml×3). The ether layer was separated and dried over anhydrous $Na_2SO_4$, and ether was allowed to evaporate under a stream of $N_2$. The isolated dry products were analyzed by GC-MS. A conversion of 16% was found for DEDBT and the products are as the following.

[5]

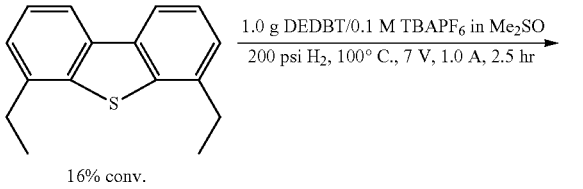

-continued

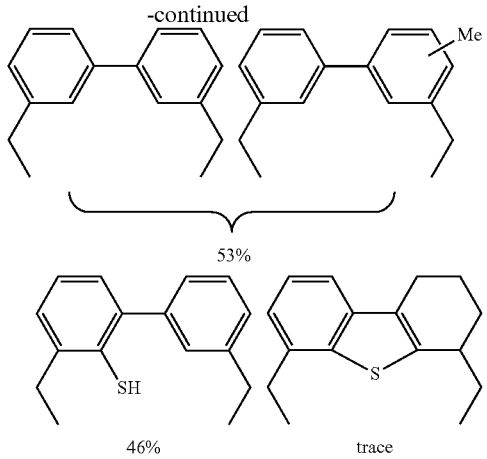

The three examples illustrated that DBT's can be readily converted into mercaptan electrochemically. The resulting mercaptans can easily be removed by caustic extraction. For example, standard Merox® caustic treatment could be used to remove these molecules from the electro-treated LSADO producing Ultra-Low Sulfur Distillate ("ULSD") without the need for additional hydrotreatment. Due to the low concentration of these molecules in the LSADO, the power consumption should be minimal. The chemistry of conversion of the DBT species to mercaptan species and subsequent removal by caustic extraction is illustrated as follows.

[6]

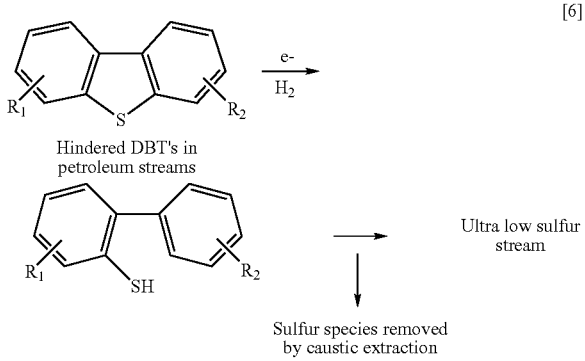

As is done commercially today by both Merox® and Merichem® processes, the extracted mercaptans can be readily oxidized to disulfides and separated from the caustic stream which is then recycled for more mercaptan extraction. The hindered DBTS which are removed from the ULSD stream are thereby converted to a very small pure stream of disulfides that can be disposed of via combustion or fed to a coking unit. Being able to target hindered DBT molecules could also enable the disposition of more Light Cat Cycle Oil ("LCCO"), which is rich in DBTs, to diesel hydrotreaters.

What is claimed is:

1. A process for removing sulfur from a sulfur-containing petroleum feedstream having at least a portion of its sulfur in the form of hindered dibenzothiophene compounds, comprising:

a) forming a mixture of an effective amount of water and said sulfur-containing petroleum feedstream;

b) passing said mixture to an electrochemical cell;

c) subjecting said mixture in the presence of nitrogen gas to an effective voltage and current that will result in the partial hydrogenation of at least a fraction of said hindered dibenzothiophene compounds to hydrogenated naphthenobenzothiophene compounds, thereby resulting in a partially-hydrogenated petroleum feedstream;

d) hydrodesulfurizing at least a portion of said partially-hydrogenated petroleum feedstream by contacting the partially-hydrogenated petroleum feedstream with a hydrodesulfurization catalyst in the presence of hydrogen at hydrodesulfurization conditions, thereby resulting in a reduced-sulfur petroleum product stream and hydrogen sulfide; and e) separating the hydrogen sulfide from said reduced-sulfur petroleum product stream;

wherein the reduced-sulfur petroleum product stream has a lower sulfur content by wt % than the sulfur-containing petroleum feedstream.

2. The process of claim 1, wherein the sulfur-containing petroleum feedstream is comprised of a bitumen.

3. The process of claim 2, wherein the electrochemical cell is run at about 4 volts to about 500 volts and a current density of about 10 to about 1000 mA/cm$^2$.

4. The process of claim 3, wherein the hydrodesulfurization catalyst is comprised of at least one Group VIII metal and at least one Group VI metal on a refractory oxide support and hydrodesulfurization temperature is from about 212° F. to about 842° F. (100° C. to 450° C.) and the hydrodesulfurization pressure is from about 50 psig to about 3,000 psig.

5. The process of claim 1, wherein the sulfur-containing petroleum feedstream is a distillate boiling range hydrocarbon stream and an effective amount of an electrolyte is mixed with the mixture of water and distillate boiling range hydrocarbon stream.

6. The process of claim 5, wherein the distillate boiling range hydrocarbon stream is a low-sulfur automotive diesel oil.

7. The process of claim 6, wherein the electrolyte is an organic electrolyte selected from quaternary carbyl- and hydrocarbyl-onium salts.

8. The process of claim 6, wherein the electrolyte is an inorganic electrolyte selected from the group consisting of sodium hydroxide, potassium hydroxide and sodium phosphates.

9. The process of claim 6, wherein the electrochemical cell is run at about 4 volts to about 500 volts and a current density of about 10 to about 1000 mA/cm$^2$.

10. The process of claim 5, wherein the electrochemical cell is run at about 4 volts to about 500 volts and a current density of about 10 to about 1000 mA/cm$^2$.

11. The process of claim 10, wherein the hydrodesulfurization catalyst is comprised of at least one Group VIII metal and at least one Group VI metal on a refractory oxide support and the temperature of hydrodesulfurization is from about 212° F. to about 842° F. (100° C. to 450° C.) at pressures from about 50 psig to about 3,000 psig.

* * * * *